US005751099A

United States Patent [19]

Van der Poel et al.

[11] Patent Number: 5,751,099

[45] Date of Patent: May 12, 1998

[54] DISPLAY DEVICE AND COLOUR CATHODE RAY TUBE FOR USE IN A DISPLAY DEVICE

[75] Inventors: Willibrordus A. J. A. Van der Poel; Tjerk G. Spanjer, both of Eindhoven, Netherlands

[73] Assignee: U.S. Philips Corporation, New York, N.Y.

[21] Appl. No.: 673,977

[22] Filed: Jul. 1, 1996

[30] Foreign Application Priority Data

Jul. 3, 1995 [EP] European Pat. Off. ..... 95201802

[51] Int. Cl.[6] ..... H01J 29/50; H01J 29/62

[52] U.S. Cl. ..... 313/412; 313/414; 313/432; 313/439

[58] Field of Search ..... 313/412, 414, 313/432, 437, 439, 444, 460; 315/382, 14, 15, 368.11

[56] References Cited

U.S. PATENT DOCUMENTS 4,887,009 12/1989 Bloom et al. ..... 313/414 X
4,890,032 12/1989 Bijma et al. ..... 313/414 X
5,300,855 4/1994 Kweon ..... 313/414
5,347,202 9/1994 Stil ..... 315/382
5,610,481 3/1997 Shirai et al. ..... 313/414 X
5,621,286 4/1997 Toujou et al. ..... 313/414 X
5,633,567 5/1997 Spanjer ..... 313/414 X

*Primary Examiner*—Ashok Patel
*Attorney, Agent, or Firm*—Robert J. Kraus

[57] ABSTRACT

A display device with a DAF-gun (Dynamic Astigmatism and Focusing) in which the first focusing electrode (G3*a*) has at the side facing the pre-focusing part of the electron gun three elongated apertures (36, 37, 38). Hereby in operation in the vicinity of the elongated apertures an electron-optical field is generated between the pre-focusing part of the electron gun and the elongated apertures for reduction of the vertical dimension (vertical meaning transverse to the plane of the electron beams) of the beam size of the electron beams in the main lens. This reduction of the electron beam size results in an increase of the vertical dimension of the beam spot on the screen. This reduces Moiré effects.

7 Claims, 3 Drawing Sheets

DISPLAY DEVICE AND COLOUR CATHODE RAY TUBE FOR USE IN A DISPLAY DEVICE

BACKGROUND OF THE INVENTION

The present invention relates to a display device comprising a colour cathode ray tube comprising in an evacuated envelope an in-line electron gun for generating three electron beams situated in one plane, said electron beams being directed to a display screen on an interior portion of the evacuated envelope, and a deflection unit for deflecting the electron beams over the screen, said electron gun comprising a pre-focusing part for forming a pre-focus and a first, a second and a third focusing electrode, each of said electrodes having apertures for passing of the electron beams, the display device comprising means for supplying in operation a first static voltage to the first focusing electrode, a dynamic voltage to the second focusing electrode, and a second static voltage to the third focusing electrode, whereby in operation a dynamically variable quadrupolar electric field is formed between the first and second focusing electrode and a dynamically variable main lens field is formed between the second and third focusing electrode.

The invention also relates to a colour cathode ray tube for use in a display device.

Such display devices are known and are used, inter alia in television receivers and colour monitors.

In operation the deflection unit generates an electromagnetic field for deflecting the electron beams generated by the in-line electron gun over the display screen. The deflection field has a defocusing effect on the electron beams and causes astigmatism. Said effects vary with the degree of deflection. The electron gun comprises means to generate a dynamically varying main lens field between the second focusing electrode and the third focusing electrode and means for generating a dynamically varying quadrupolar field between the first and second focusing electrode. The dynamic variation of the strength of the main lens and of the quadrupolar field enables astigmatism and focusing of the electron beams to be controlled as a function of the deflection so that astigmatism caused by the deflection field is at least partly compensated and that the electron beams are substantially everywhere in focus on the screen. This improves the reproduction of the picture on the screen. Such electron guns are sometimes referred in literature as DAF-guns (Dynamic Astigmatism and Focusing).

SUMMARY OF THE INVENTION

Although the astigmatism caused by the deflection field is compensated for in the display devices according to the state of the art disturbing effects may nevertheless occur, in particular at the edges of the screen and for larger angles of deflection. For example and in particular so-called scan Moiré effects may occur. It is an object of the invention to provide a display device of the type as described in the opening paragraph of simple design in which said disturbing Moiré effects are reduced.

To this end the part of the first focusing electrode adjacent the pre-focusing part has three apertures for passing the electron beams which apertures are elongated in a direction transverse to the plane of the electron beams.

Scan Moiré is an interference between the mask structure and the line structure written by the electron beams. Its modulation depth is among other factors dependend on the linewidth of an individual line: a too narrow line will give rise to this effect. This occurs in particular near and on the left and right edges of the screen.

In a device according to the invention in operation in the vicinity of the elongated apertures a static astigmatic electron-optical field is generated between the pre-focusing part of the electron gun and the mentioned elongated apertures of the first focusing electrode, which field reduces the vertical dimension (vertical meaning transverse to the plane of the electron beams) of the beams in the main lens. This reduction of the vertical beam sizes results in an increase of the vertical dimension of the beam spot on the screen. The increase of the beam spot in the vertical direction reduces the scan Moiré effects. The design of the electron gun in the display device and colour cathode ray tube according to the invention is simple, and does not require extra electrodes or extra supply means to be used. Furthermore it is advantageous that the elongated apertures in the first focusing electrode do not influence in any appreciable manner the pre-focusing lens field of the electron gun, as elongated apertures in an electrode of the pre-focusing part would do. This enables the invention to be implemented in existing design of electron guns without the need for substantially redesigning of the pre-focusing part of the electron gun. Furthermore small irregularities on the form of the elongated apertures, such as burrs, have little or no influence on the quadrupolar field generated. Preferably the pre-focusing part of the electron gun comprises a first and a second pre-focusing electrode, the second pre-focusing electrode facing the first focusing electrode. This preferred embodiment is of simple design, yet enables an reduction of scan Moiré patterns.

Preferably the first focusing electrode comprises two sub-electrodes, one part facing the second focusing electrode, and the other part having the elongated apertures, which parts are arranged nested into each other.

In such embodiments the distance between the elongated apertures and the main lens is variable. This enables the same basic design to be used for different electron guns.

BRIEF DESCRIPTION OF THE DRAWING

These and other aspects of the invention will below be further illustrated, by way of example with reference to a drawing in which.

DESCRIPTION OF THE PREFERRED EMBODIMENTS

Figure 1:
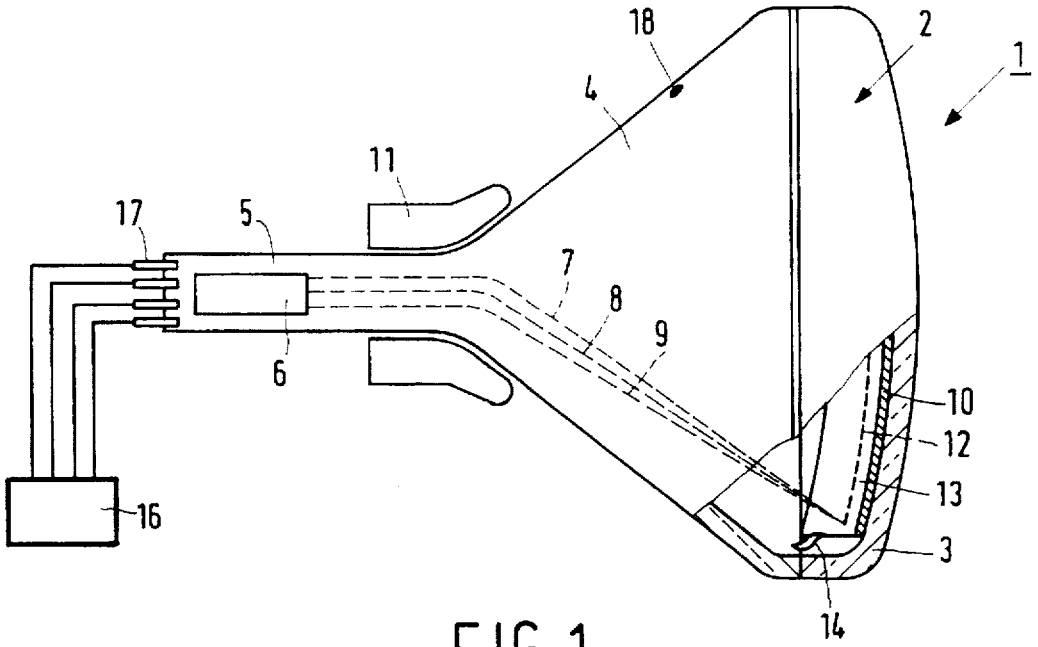
FIG. 1 is a longitudinal section of a display device according to the invention.

FIG. 1 shows a colour display tube of the "in-line" type in a longitudinal section. In a glass envelope 1, which is composed of a display window 2 having a face plate 3, a cone 4 and a neck 5, this neck accommodates an integrated electron gun system 6 which generates three electron beams 7, 8 and 9 whose axes are located in the plane of the drawing. The axis of the central electron beam 8 initially coincides with the tube axis. The inside of the face plate 3 is provided with a large number of triplets of phosphor elements. The elements may consists of lines or dots. Each triplet comprises an element consisting of a blue green luminescing phosphor, an element consisting of a green luminescing phosphor and an element consisting of a red green luminescing phosphor. All triplets combined constitute the display screen 10. The three co-planar electron beams are deflected by deflection means, for instance by a system of deflection coils 11. Positioned in front of the display screen is the shadow mask 12 in which a large number of elongated apertures 13 is provided through which the electron beams 7, 8 and 9 pass, each impinging only on phosphor elements of one colour. The shadow mask is suspended in the display window by means of suspension means 14.The device further comprises means 16 for supplying voltages to the electron gun system via feedthroughs 17. The colour cathode ray tube also comprises a so-called anode button 18. This anode button 18 is a high voltage lead through which in operation a high voltage is supplied to a third focusing electrode via a conducting layer on the inside on the cone of the envelope.

Figure 2A:
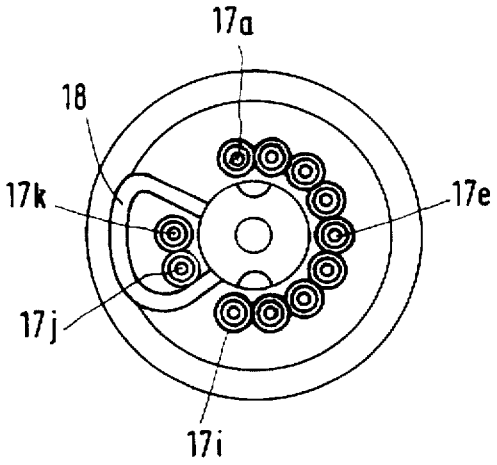
FIGS. 2A and 2B illustrate schematically the leads at the end of the neck of the colour cathode ray tube.
Figure 2B:
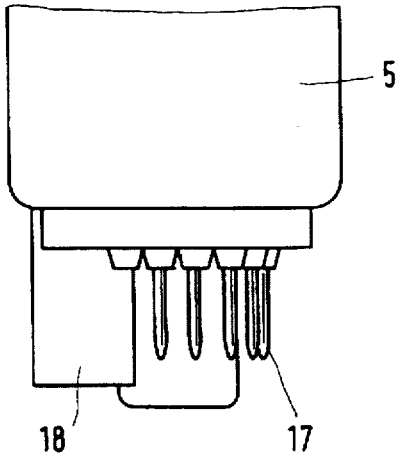

FIGS. 2A and 2B show schematically the feedthroughs 17 in the neck 5 of the cathode ray tube. FIG. 2A shows a frontal view, FIG. 2B a side view. Feedthroughs 17*a* to 17*i* are low-voltage leads for supplying low voltages (up to 2 kVolt) to heaters, cathodes and pre-focusing electrodes. Feedthroughs 17*j* and 17*k* are high-voltage leads for supplying high voltages (higher than approximately 5 kVolt) to the first and second focusing electrodes. The high voltage leads 17*j* and 17*k* are set apart from the other leads (17*a* to 17*i*) and can be recognized as high voltage leads by the fact that they are separated by a relatively large distance from the other feedthroughs and are surrounded by a safety box 18 made of non-conducting material.

Figure 3:
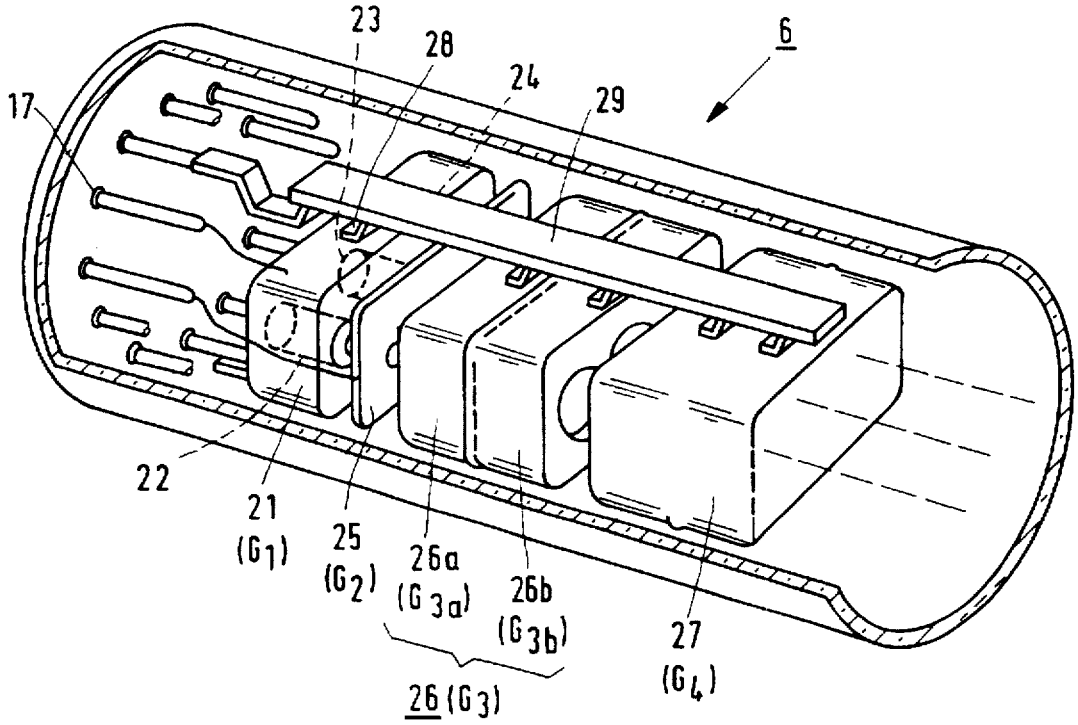
FIG. 3 is a perspective view of an electron gun as used in the colour display tube of FIG. 1, FIGS. 4 and 5 are cut-away views of electron guns suitable for use in the colour display tube of FIG. 1.

FIG. 3 is a perspective view on an electron gun as used in the display tube shown in FIG. 1.

The electron gun system 6 comprises a common control electrode 21, also referred to as the G1-electrode, in which three cathodes 22, 23 and 24 are secured. In this example the G1-electrode forms the first pre-focusing electrode of the pre-focusing part of the electron gun. The electron gun system further comprises a common plate-shaped electrode 25, also referred to as the G2-electrode, which forms the second pre-focusing electrode of the pre-focusing part of the electron gun. The electron gun system further comprises a third common electrode 26, also referred to the G3-electrode, which electrode comprises two sub-electrode 26*a* and 26*b* (also referred to as the G3*a* and G3*b*-electrode). Sub-electrode 26*a* forms the first focusing electrode, and sub-electrode 26*b* forms the second focusing electrode. The electron gun further comprises a final accelerating electrode 27, (also referred to as the G4-electrode), which forms the third focusing electrode. All electrodes are via braces 28 connected to a ceramic carrier 29. Only one of these carriers is shown in this figure. The neck of the envelope is provided with electrical feedthroughs 17, electrical connection between the feedthroughs and some of the electrodes are schematically shown in FIG. 3. In operation, a pre-focusing lens is formed in front of the G3-electrode and a main lens for focusing the electron beam on the screen is formed between sub-electrode 26*b* (=the second focusing electrode) and final accelerating electrode 27 (=the third focusing electrode). The deflection field generated by the deflection means has detrimental effect on the focusing of the electron beams, more specifically the electron beams are astigmatically focused as a function of the deflection angle. In order to counteract these effects a dynamically varying quadrupolar field is generated between the first and second focusing electrodes 26*a* and 26*b* (G3*a* and G3*b* ) which counteract, at least partly, the astigmatism caused by the deflection field. To generate such a dynamically varying field in this example, the first and second focusing electrode are, in operation, respectively supplied with a constant and a dynamically varying voltage via the high-voltage leads 17*j* and 17*k*. The third focusing electrode is in this example in operation supplied with a constant high voltage via the anode button and a conducting layer on the inside of the cone 4.

In operation the strength of the main lens between the second and third focusing electrodes (16*a* and 27) is dynamically varied to counteract de-focusing effects of the deflection field.

Such electron gun as also called DAF(Dynamic Astigmatism and Focusing)-guns.

Although such electron guns compensate for astigmatism and focusing errors caused by the deflection field, nevertheless disturbing effects may occur, in particular at the edges of the screen or at large deflection angles. In particular the so-called Moiré effects are disturbing.

Figure 4:
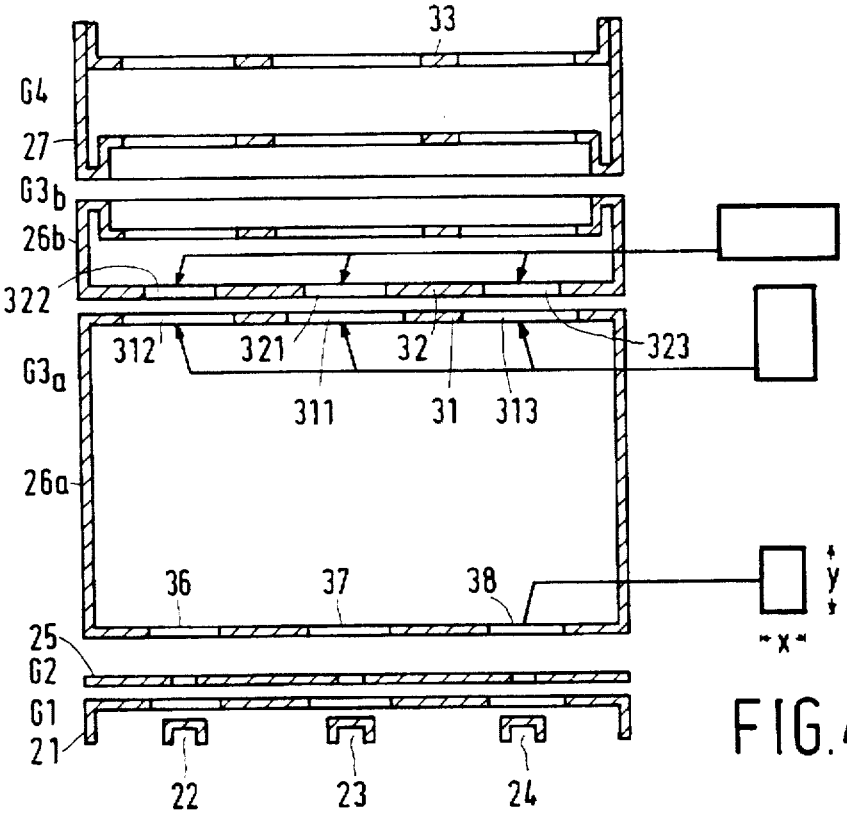

FIG. 4 is a cut-away view of an electron gun as used in the colour display tube of FIG. 1.

The three cathodes (22, 23, and 24) are shown. Furthermore the first and second pre-focusing electrodes (G1(21) and G2(25)) are shown, as are the first, second and third focusing electrode (G3*a*(26*a*), G3*b*(26*b*) and G4(27)). The shapes of the facing apertures (311, 312, 313, 321, 322, 323) of the second and third focusing electrode are indicated. In this example the facing apertures are substantially rectangular. This is not to be considered as restrictive. Such fields can be achieved by other shapes of the apertures such as ovals, or by providing the apertures with extensions.

The form of the elongated apertures 36, 37 and 38 is indicated in the drawing. The apertures are elongated in the direction transverse to the plane of the electron beams (this plane is also commonly called the in-line plane). Hereby an astigmatic static electrical field having a quadrupole component (further also indicated for brevity as a "quadrupolar field") is formed between the pre-focusing part and the first focusing(G3*a*)-electrode, in this example between the second pre-focusing electrode (G2) and the first focusing electrode (G3*a*). This static quadrupolar field decreases the vertical size of the electron beams in the main lens (between the G3*b* and G4-electrodes). As a consequence the vertical dimension of the spot of the electron beams on the screen is increased. This increase reduces the Moiré effects. The invention is advantageous as it does not require one or more extra electrodes to be used. The elongation of the apertures in the G3*a* electrode facing the G2 electrode does not or only to a very limited extent influence the pre-focusing part of the electron gun. This is advantageous since thereby the invention can be readily implemented in existing electron guns without a need for a redesign of the pre-focusing part of the electron gun, as would be the case if the apertures in for instance the G2 electrode would have been elongated. Furthermore, compared to the apertures in the G2 electrodes the apertures in the G3 electrodes are relatively large. Small errors in the apertures, such as burrs or small misalignments have a relatively small detrimental effect on the electron beams. Table 1 gives, as an example, the dimensions of apertures in the G1 to G3*b*. The x-dimension stands for the dimension in the in-line plane, the y-dimension stands for the dimension transverse to the in-line plane.

| electrode | form of apertures | x-dimension | y-dimension |
|---|---|---|---|
| G1 | circular | 0.4 mm | 0.4 mm |

-continued

| electrode | form of apertures | x-dimension | y-dimension |
|---|---|---|---|
| G2 | circular | 0.5 mm | 0.5 mm |
| G3a entrance | elongated | 1.15 mm | 1.5 mm |
| G3a exit | elongated | 3.5 mm | 5.0 mm |
| 63b entrance | elongated | 5.0 mm | 3.5 mm |

Figure 5:
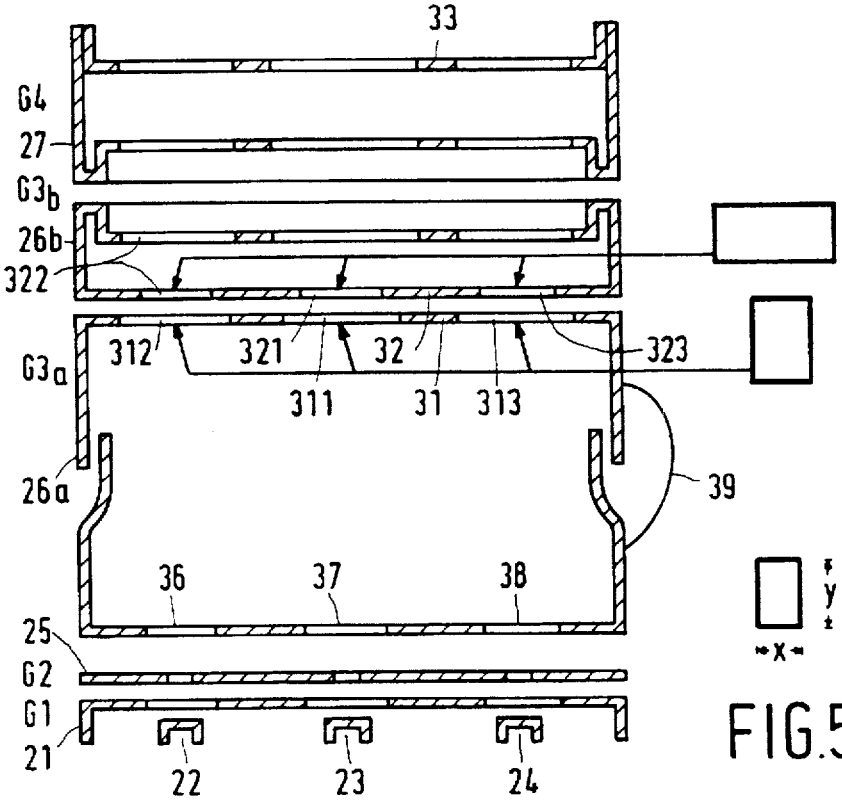

FIG. 5 shows an advantageous embodiment of an electron gun as shown in FIG. 4. In FIG. 5 a G3*a* electrode is shown comprised of two-sub-electrodes, nested into each other. The two sub-electrodes are electrically connected via a lead 39. Electron-optically such an electrode is substantially equivalent with the electrode shown in FIG. 4. However, the relative position of the two sub-electrode can be chosen. This enables the same design to be used for different electron guns.

In summary the present invention provides a display device and a colour cathode ray tube with an in-line DAF-gun (Dynamic Astigmatism and Focusing) in which the first focusing electrode (G3*a*) has at the side facing the pre-focusing part of the electron gun three elongated apertures (36, 37, 38). Hereby in operation in the vicinity of the elongated apertures a static electron-optical field is generated between the pre-focusing part of the electron gun and the elongated apertures for reduction of the vertical dimension (vertical meaning transverse to the plane of the electron beams) of the beam size of the electron beams in the main lens. This reduction of the electron beam size results in an increase of the vertical dimension of the beam spot on the screen. This reduces scan Moiré effects.

It will be clear that within the framework of the invention many variations are possible.

We claim:

1. Display device comprising a colour cathode ray tube comprising in an evacuated envelope an in-line electron gun for generating three electron beams situated in one plane, said electron beams being directed to a display screen on an interior portion of the evacuated envelope, and a deflection unit for deflecting the electron beams over the screen, said electron gun comprising:

a pre-focusing part for forming a pre-focusing electric field, a first, a second and a third focusing electrode, each of said electrodes having apertures for passing the electron beams, wherein the display device comprises means for supplying in operation a first static voltage to the first focusing electrode, a dynamic voltage to the second focusing electrode, and a second static voltage to the third focusing electrode, whereby a dynamic quadrupolar electric field is formed between the first and second focusing electrode and a dynamic main lens is formed between the second and third focusing electrode, characterized in that the part of the first focusing electrode adjacent the prefocusing part has three apertures for passing the electron beams, which apertures are elongated in a direction perpendicular to the plane of the electron beams for forming a qauadrupolar prefocusing electric field lens.

2. Display device as claimed in claim 1, characterized in that the prefocusing part of the electron gun comprises a first and a second pre-focusing electrode, the second pre-focusing electrode facing the first focusing electrode.

3. Display device as claimed in claim 1 or 2, characterized in that the first focusing electrode comprises two sub-electrodes, one part facing the second focusing electrode, and the other part having the elongated apertures, which parts are arranged nested into each other.

4. Colour cathode ray tube comprising in an evacuated envelope an in-line electron gun for generating three electron beams situated in one plane, said electron beams being directed to a display screen on an interior portion of the evacuated envelope, and a deflection unit for deflecting the electron beams over the screen, said electron gun comprising:

a pre-focusing part, a first, a second and a third focusing electrode, each of said electrodes having apertures for passing the electron beams, wherein the display device comprises a first high voltage lead connected to the first focusing electrode, a second high voltage lead connected to the second focusing electrode, and a third high voltage lead connected to the third focusing electrode, the apertures in the first and second focusing electrode being formed to generat, in operation, an electric field having a quadrupolar component, characterized in that the part of the first focusing electrode adjacent the pre-focusing part has three apertures for passing the electron beams, which apertures are elongated in a direction perpendicular to the plane of the electron beams for forming a quadrupolar prefocusing electric field lens.

5. Colour cathode ray tube as claimed in claim 4, characterized in that the pre-focusing part of the electron gun comprises a first and a second pre-focusing electrode, the second pre-focusing electrode facing the first focusing electrode.

6. A display device as in claim 1 where, in operation, the quadrupolar prefocusing electric field is a static field.

7. A cathode ray tube as in claim 4 where, in operation, the quadrupolar prefocusing electric field is a static field.

* * * * *